US011181130B2

(12) United States Patent
Hayashi et al.

(10) Patent No.: US 11,181,130 B2
(45) Date of Patent: Nov. 23, 2021

(54) METHOD AND SYSTEM FOR DIAGNOSING ABNORMALITY OF HYDRAULIC DEVICE

(71) Applicant: MITSUBISHI HEAVY INDUSTRIES, LTD., Tokyo (JP)

(72) Inventors: Toshikazu Hayashi, Tokyo (JP); Hiroyoshi Kubo, Tokyo (JP); Atsushi Yuge, Tokyo (JP); Kentaro Hayashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 99 days.

(21) Appl. No.: 16/392,927

(22) Filed: Apr. 24, 2019

(65) Prior Publication Data

US 2019/0338792 A1 Nov. 7, 2019

(30) Foreign Application Priority Data

May 1, 2018 (JP) ..... JP2018-088316

(51) Int. Cl.

*F15B 19/00* (2006.01)
*F15B 20/00* (2006.01)
*F04B 49/10* (2006.01)

(52) U.S. Cl.

CPC ..... *F15B 19/005* (2013.01); *F04B 49/10* (2013.01); *F15B 19/007* (2013.01); *F15B 20/00* (2013.01); *F04B 2201/12* (2013.01)

(58) Field of Classification Search

CPC ..... F15B 19/005; F15B 19/007; F04B 49/10; F04B 2201/12

See application file for complete search history.

(56) References Cited

U.S. PATENT DOCUMENTS

| | | | | |
|---|---|---|---|---|
| 8,515,719 | B2 | 8/2013 | Tamaki et al. | |
| 10,067,038 | B2 * | 9/2018 | Hou | F04B 51/00 |
| 2016/0195082 | A1 * | 7/2016 | Wiegman | F04B 49/065 417/53 |
| 2017/0292513 | A1 * | 10/2017 | Haddad | G06F 30/20 |

FOREIGN PATENT DOCUMENTS

| | | |
|---|---|---|
| JP | 08-226411 | 9/1996 |
| JP | 09-256945 | 9/1997 |
| JP | 2013-160157 | 8/2013 |

* cited by examiner

*Primary Examiner* — Gary Collins

(74) *Attorney, Agent, or Firm* — Wenderoth, Lind & Ponack, L.L.P.

(57) ABSTRACT

An abnormality diagnosis method is targeted at a hydraulic device which includes a hydraulic pump and a driven device driven by the hydraulic pump. The method includes calculating a frequency distribution with regard to a deviation between a normal value of an output parameter corresponding to an operation condition and an actual measurement value of the output parameter using a prediction model, and determining the presence of an abnormality if an average of the deviation exceeds a threshold. If the presence of the abnormality is determined, a factor of the abnormality is estimated based on the range of the deviation where a waveform peak of the frequency distribution exists.

11 Claims, 12 Drawing Sheets

METHOD AND SYSTEM FOR DIAGNOSING ABNORMALITY OF HYDRAULIC DEVICE

TECHNICAL FIELD

The present disclosure relates to an abnormality diagnosis method for a hydraulic device including a hydraulic pump and an abnormality diagnosis system for the hydraulic device.

BACKGROUND ART

A hydraulic device which uses oil as an operation medium is known. The hydraulic device of this type may include a hydraulic pump which produces pressurized oil by power input from a power source such as an engine, electric motor, or the like and a driven device which is driven by the pressurized oil produced by the hydraulic pump. As such a hydraulic device, there is a hydrostatic transmission (HST) including a hydraulic motor as a driven device.

As the hydraulic pump used for the hydraulic device, JPH9-256945A discloses an axial-piston hydraulic pump. The axial-piston hydraulic pump includes a cylinder block with a plurality of cylinders. When the cylinder block rotates by power from a power source, a plurality of pistons disposed in the respective cylinders reciprocate in a range defined by a swash plate. Consequently, working oil is sucked and discharged from a suction port and a discharge port on a valve plate which communicate with cylinder ports opening on a sliding surface of the cylinder block, producing pressurized oil.

SUMMARY

In the hydraulic device including the hydraulic pump as of JPH9-256945A, it is known that, for example, progressing abrasion in gaps formed between the cylinders and the pistons in the hydraulic pump increases the leakage amount of working oil from the gaps, or an increasing friction coefficient on a sliding surface between the cylinder block and the valve plate decreases an output. Such an abnormality can be diagnosed by monitoring respective parameters such as input characteristics (rotation speed, torque, and operation amount), state amounts (temperature and pressure), and output characteristics (rotation speed and torque) of the hydraulic device. In an actual hydraulic device, however, it is difficult to monitor all of these parameters because of restrictions in terms of cost and layout.

In addition, it is difficult to detect the decrease in output just by directly measuring the leakage amount of the working oil used for the hydraulic device and the friction coefficient on the sliding surface because the viscosity (density× kinetic viscosity) of the working oil has a non-linear correlation with respect to a temperature. Moreover, the leakage amount of the working oil in the gaps between the cylinders and the pistons is in proportion to the third power of the gap, and is thus likely to be influenced by an individual difference of hydraulic devices as well.

Furthermore, if the abnormality is detected in the hydraulic device as a result of the diagnosis, many sensors need to be arranged in accordance with the number of parameters required for factor specification. In practice, however, it is difficult to monitor all of these parameters because of the above-described restrictions in terms of cost and layout.

At least one embodiment of the present invention is made in view of the above. An object of at least one embodiment of the present invention is to provide an abnormality diagnosis method for a hydraulic device and an abnormality diagnosis system for the hydraulic device, which can accurately diagnose the presence or absence and a factor of an abnormality in the hydraulic device based on limited parameters.

(1) In order to solve the above-described problems, an abnormality diagnosis method for a hydraulic device according to at least one embodiment of the present invention is an abnormality diagnosis method for a hydraulic device which includes a hydraulic pump and a driven device driven by the hydraulic pump, the method including a step of generating a prediction model capable of predicting a normal value of an output parameter of the hydraulic device for each operation condition of the hydraulic device, a step of obtaining an operation condition of the hydraulic pump, a step of calculating the normal value of the output parameter corresponding to the operation condition using the prediction model, a step of obtaining an actual measurement value of the output parameter with respect to the hydraulic pump, a step of calculating a frequency distribution with regard to a deviation between the normal value and the actual measurement value, a step of calculating an average of the deviation based on the frequency distribution, and determining that the hydraulic device has an abnormality if the average exceeds a threshold, and a step of estimating a factor of the abnormality based on a range of the deviation where a waveform peak of the frequency distribution exists, if it is determined that the hydraulic device has the abnormality.

With the above method (1), it is possible to determine the abnormality in the hydraulic device by calculating the normal value of the output parameter corresponding to the operation condition based on the prediction model and comparing the frequency distribution of the deviation from the actual measurement value with the threshold. Then, if it is determined that the hydraulic device has the abnormality, it is possible to estimate the factor of the abnormality that has occurred in the hydraulic device by analyzing the waveform of the frequency distribution.

(2) In some embodiments, in the above method (1), the step of estimating the factor includes calculating a standard deviation $\sigma$ with respect to the frequency distribution calculated in a case in which the hydraulic device has a load greater than or equal to a predetermined value and estimating that the factor is an increasing friction coefficient in a sliding portion inside the hydraulic pump, if a peak is within a range of $\pm 3\sigma$ in the frequency distribution.

According to the research conducted by the present inventors, it is found that if the factor of the abnormality in the hydraulic device is the increase in the friction coefficient in the sliding portion inside the hydraulic pump, the peak of the frequency distribution calculated in a case in which the hydraulic device has the load greater than or equal to the predetermined value is in the range of $\pm 3\sigma$. In the above method (2), based on such a finding, it is possible to estimate the factor by determining whether the peak of the frequency distribution is in the range of $\pm 3\sigma$.

(3) In some embodiments, in the above method (2), the step of estimating the factor includes calculating a standard deviation $\sigma$ with respect to the calculated frequency distribution and estimating that the factor is an increasing abrasion amount inside the hydraulic pump, if a peak is out of a range of $\pm 3\sigma$ in the frequency distribution.

According to the research conducted by the present inventors, it is found that if the factor of the abnormality in the hydraulic device is the increase in the abrasion amount inside the hydraulic pump, the peak of the frequency distribution calculated when the hydraulic device is in a high-load state (a state in which the load is greater than or equal to the predetermined value) is out of the range of ±3σ. In the above method (3), based on such a finding, it is possible to estimate the factor by determining whether the peak of the frequency distribution is out of the range of ±3σ.

(4) In some embodiments, in the above method (1), the operation condition includes a temperature of working oil discharged from the hydraulic pump.

With the above method (4), it is possible to predict the normal value considering the influence of the temperature of the working oil on the viscosity of the working oil by including the temperature in the operation conditions. Thus, it is possible to determine the abnormality in consideration of the temperature dependency of the viscosity of the working oil.

(5) In some embodiments, in the above method (1), the driven device is a hydraulic motor, and the output parameter is an output rotation speed of the hydraulic motor.

With the above method (5), it is possible to accurately diagnose the abnormality in the hydrostatic transmission which serves as the hydraulic device including the hydraulic pump and the hydraulic motor by using the output rotation speed of the hydraulic motor as the output parameter.

(6) In order to solve the above-described problems, an abnormality diagnosis method for a hydraulic device according to at least one embodiment of the present invention is an abnormality diagnosis method for a hydraulic device which includes a hydraulic pump and a driven device driven by the hydraulic pump, the method including a step of generating a prediction model capable of predicting a normal value of an output parameter of the hydraulic device for each operation condition of the hydraulic device, a step of obtaining an operation condition of the hydraulic pump, a step of calculating the normal value of the output parameter corresponding to the operation condition using the prediction model, a step of obtaining an actual measurement value of the output parameter with respect to the hydraulic pump, and a step of calculating a frequency distribution with regard to a deviation between the normal value and the actual measurement value, a step of calculating an average of the deviation based on the frequency distribution and determining that the hydraulic device has an abnormality, if the average exceeds a threshold, and a step of estimating a factor of the abnormality based on a pressure of working oil discharged from the hydraulic pump, if it is determined that the hydraulic device has the abnormality.

With the above method (6), it is possible to determine the abnormality in the hydraulic device by calculating the normal value of the output parameter corresponding to the operation condition based on the prediction model and comparing the frequency distribution of the deviation from the actual measurement value with the threshold. Then, if it is determined that the hydraulic device has the abnormality, it is possible to estimate the factor of the abnormality that has occurred in the hydraulic device by analyzing the pressure of the working oil discharged from the hydraulic pump.

(7) In some embodiments, in the above method (6), the step of estimating the factor includes estimating that the factor is an increasing friction coefficient in a sliding portion inside the hydraulic pump, if the pressure of the working oil discharged from the hydraulic pump increases as compared with a normal time.

(8) In some embodiments, in the above method (6), the step of estimating the factor includes estimating that the factor is an increasing abrasion amount inside the hydraulic pump, if the pressure does not increase as compared with a normal time.

(9) In some embodiments, in the above method (6), the operation condition includes a temperature of the working oil discharged from the hydraulic pump.

With the above method (9), it is possible to predict the normal value considering the influence of the temperature of the working oil on the viscosity of the working oil by including the temperature in the operation conditions. Thus, it is possible to determine the abnormality in consideration of the temperature dependency of the viscosity of the working oil.

(10) In some embodiments, in the above method (6), the driven device is a hydraulic motor, and the output parameter is an output rotation speed of the hydraulic motor.

With the above method (10), it is possible to accurately diagnose the abnormality in the hydrostatic transmition transmission which serves as the hydraulic device including the hydraulic pump and the hydraulic motor by using the output rotation speed of the hydraulic motor as the output parameter.

(11) In order to solve the above-described problems, an abnormality diagnosis system for a hydraulic device according to at least one embodiment of the present invention is an abnormality diagnosis system for a hydraulic device which includes a hydraulic pump and a driven device driven by the hydraulic pump, the system including a prediction model generation unit which generates a prediction model capable of predicting a normal value of an output parameter of the hydraulic device for each operation condition of the hydraulic device, an operation condition obtaining unit which obtains an operation condition of the hydraulic device, a normal value calculation unit which calculates, using the prediction model, the normal value of the output parameter corresponding to the operation condition obtained by the operation condition obtaining unit, an actual measurement value obtaining unit which obtains an actual measurement value of the output parameter with respect to the hydraulic pump, a frequency distribution calculation unit which calculates a frequency distribution with regard to a deviation between the normal value calculated by the normal value calculation unit and the actual measurement value obtained by the actual measurement value obtaining unit, an abnormality determination unit which calculates an average of the deviation based on the frequency distribution and determines that the hydraulic device has an abnormality if the average exceeds a threshold, and a factor estimation unit which estimates a factor of the abnormality based on a range of the deviation where a waveform peak of the frequency distribution exists, if the abnormality determination unit determines that the hydraulic device has the abnormality.

With the above method (8), it is possible to determine the abnormality in the hydraulic device by calculating the normal value of the output parameter corresponding to the operation condition based on the prediction model and comparing the frequency distribution of the deviation from the actual measurement value with the threshold. Then, if it is determined that the hydraulic device has the abnormality, it is possible to estimate the factor of the abnormality that has occurred in the hydraulic device by analyzing the waveform of the frequency distribution.

According to at least one embodiment of the present invention, it is possible to provide the abnormality diagnosis method for the hydraulic device and the abnormality diagnosis system for the hydraulic device, which can accurately diagnose the presence or absence and the factor of the abnormality in the hydraulic device based on the limited parameters.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

An abnormality diagnosis method according to at least one embodiment of the present invention is to diagnose a hydraulic device which includes a hydraulic pump and a driven device driven by the hydraulic pump. As the hydraulic device, a hydrostatic transmission (HST) 1 is exemplary described below. The hydraulic device may be a hydromechanical transmission (HMT) obtained by further combining the hydrostatic transmission with a gear mechanism.

Figure 1:
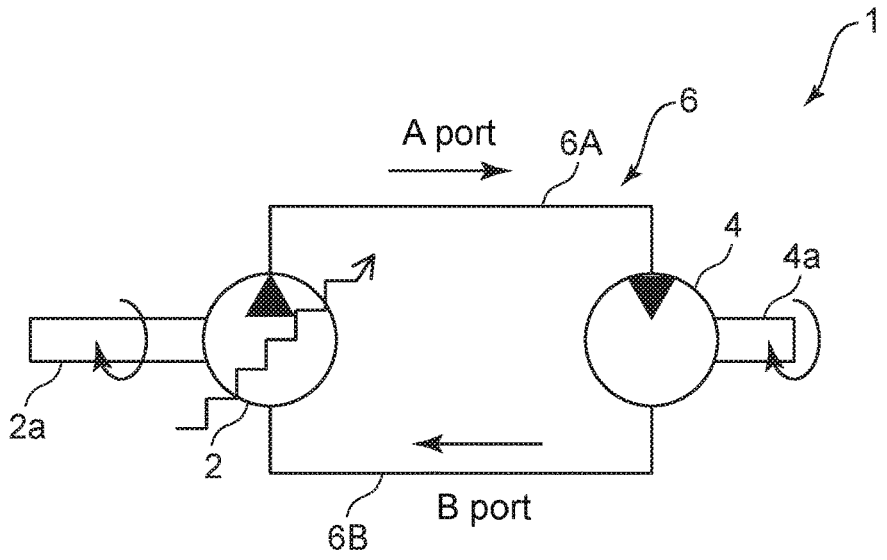
FIG. 1 is a schematic view of the overall configuration of a hydrostatic transmission.

FIG. 1 is a schematic view of the overall configuration of the hydrostatic transmission 1. The hydrostatic transmition 1 includes a hydraulic pump 2, a hydraulic motor 4, and a hydraulic line 6.

The hydraulic pump 2 has an input shaft 2*a* coupled to a power source such as an engine or an electric motor and is driven by a rotation input to the input shaft 2*a*, pressurizing working oil to produce pressurized oil. The hydraulic motor 4 is a driven device which is driven by the working oil supplied from the hydraulic pump 2 via the hydraulic line 6 and outputs a rotation from an output shaft 4*a*. The hydraulic line 6 includes a high-pressure line 6A and a low-pressure line 6B disposed between the hydraulic pump 2 and the hydraulic motor 4.

The high-pressure line 6A connects a discharge side of the hydraulic pump 2 and a suction side of the hydraulic motor 4. The low-pressure line 6B connects a suction side of the hydraulic pump 2 and a discharge side of the hydraulic motor 4. The working oil (high-pressure oil) discharged from the hydraulic pump 2 flows into the hydraulic motor 4 via the high-pressure line 6A and drives the hydraulic motor 4. The working oil (low-pressure oil) having performed work in the hydraulic motor 4 flows into the hydraulic pump 2 via the low-pressure line 6B, is pressurized by the hydraulic pump 2, and then flows into the hydraulic motor 4 again via the high-pressure line 6A.

Figure 2:
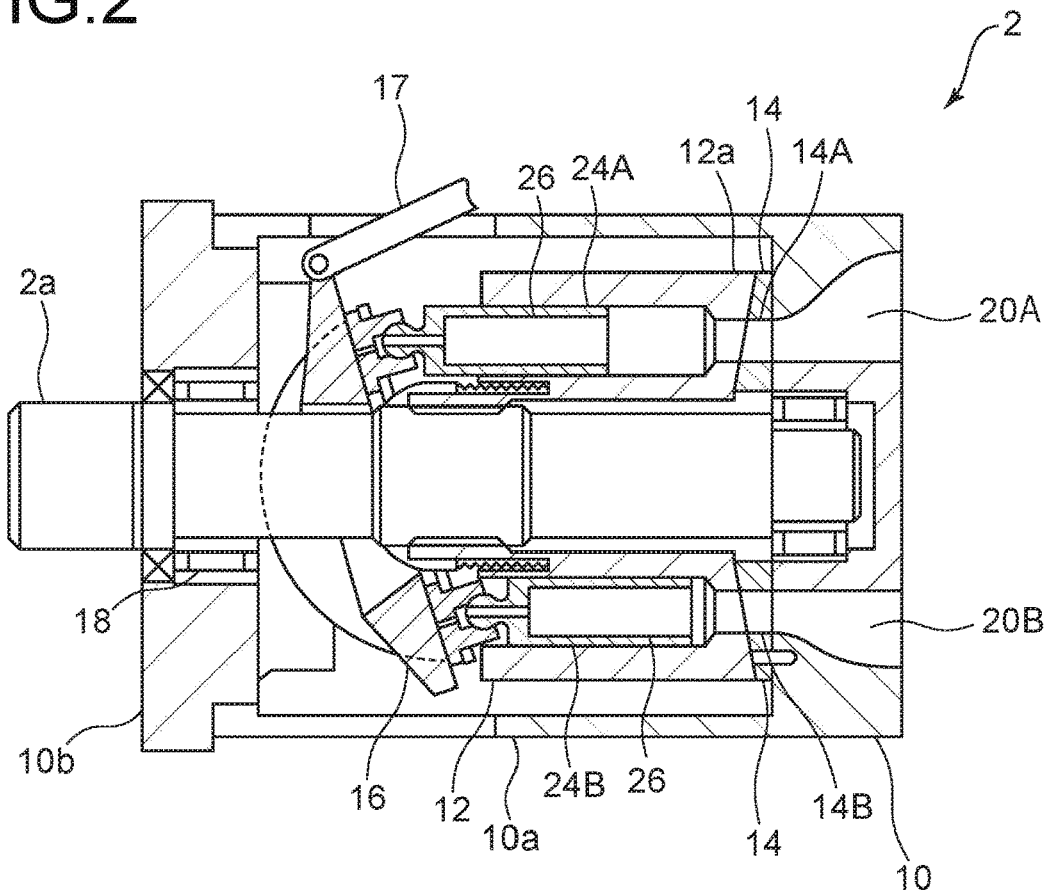
FIG. 2 is a cross-sectional view of a hydraulic pump in FIG. 1.

FIG. 2 is a cross-sectional view of the hydraulic pump 2 in FIG. 1. The hydraulic pump 2 is an axial piston hydraulic pump, and includes a housing 10, a cylinder block 12, a valve plate 14, a swash plate 16, and a bearing 18.

The housing 10 has a bottomed substantially cylindrical shape including a bottom wall portion 10*a* and a side wall portion 10*b*. The housing 10 includes a first oil channel 20A communicating with the high-pressure line 6A and a second oil channel 20B communicating with the low-pressure line 6B. That is, the working oil (high-pressure oil) discharged from the hydraulic pump 2 is discharged to the high-pressure line 6A via the first oil channel 20A, and the working oil (low-pressure oil) supplied to the hydraulic pump 2 is taken into the second oil channel 20B via the low-pressure line 6B.

The cylinder block 12 is a rotor rotatable about the input shaft 2*a* in the housing 10. The cylinder block 12 includes a plurality of cylinders 24. FIG. 2 representatively shows, of the plurality of cylinders 24, a first cylinder 24A communicating with the first oil channel 20A and a second cylinder 24B communicating with the second oil channel 20B. The plurality of cylinders 24 include pistons 26 inserted thereinto. The pistons 26 are configured to reciprocate in the cylinders 24 in accordance with a rotation of the cylinder block 12.

The cylinder block 12 has a sliding surface 12*a* facing the valve plate 14 disposed on the bottom wall portion 10*a* of the housing 10. The sliding surface 12*a* slides relative to the valve plate 14 when the cylinder block 12 rotates and includes a solid lubrication film on its surface.

The valve plate 14 is fixed to the bottom wall portion 10*a* of the housing 10, and includes a high-pressure side port 14A and a low-pressure side port 14B. The side of the valve plate 14 facing the cylinder block 12 slides relative to the sliding surface 12*a* of the cylinder block 12. The high-pressure side port 14A communicates with the first oil channel 20A, and the low-pressure side port 14B communicates with the second oil channel 20B.

The swash plate 16 is directly or indirectly fixed to the housing 10 and defines a range in which each of the pistons 26 of a corresponding one of the cylinders 24 can reciprocate. The volume ratio between the first cylinder 24A communicating with the high-pressure side port 14A and the second cylinder 24B communicating with the low-pressure side port 14B is determined by the inclination angle of the swash plate 16 when the cylinder block 12 rotates. The inclination angle of the swash plate 16 can be varied by an adjusting member 17. The above-described volume ratio is changed by varying the inclination angle of the swash plate 16 with the adjusting member 17. As a result, the discharge amount of the hydraulic pump 2 is adjusted.

Next, the abnormality diagnosis method for the hydrostatic transmission 1 having the above configuration will be described. The abnormality diagnosis method performed by using an abnormality diagnosis system according to at least one embodiment of the present invention will be described here. However, respective steps of the abnormality diagnosis method may be performed by a device other than the abnormality diagnosis system or humans such as workers.

First Embodiment

Figure 3:
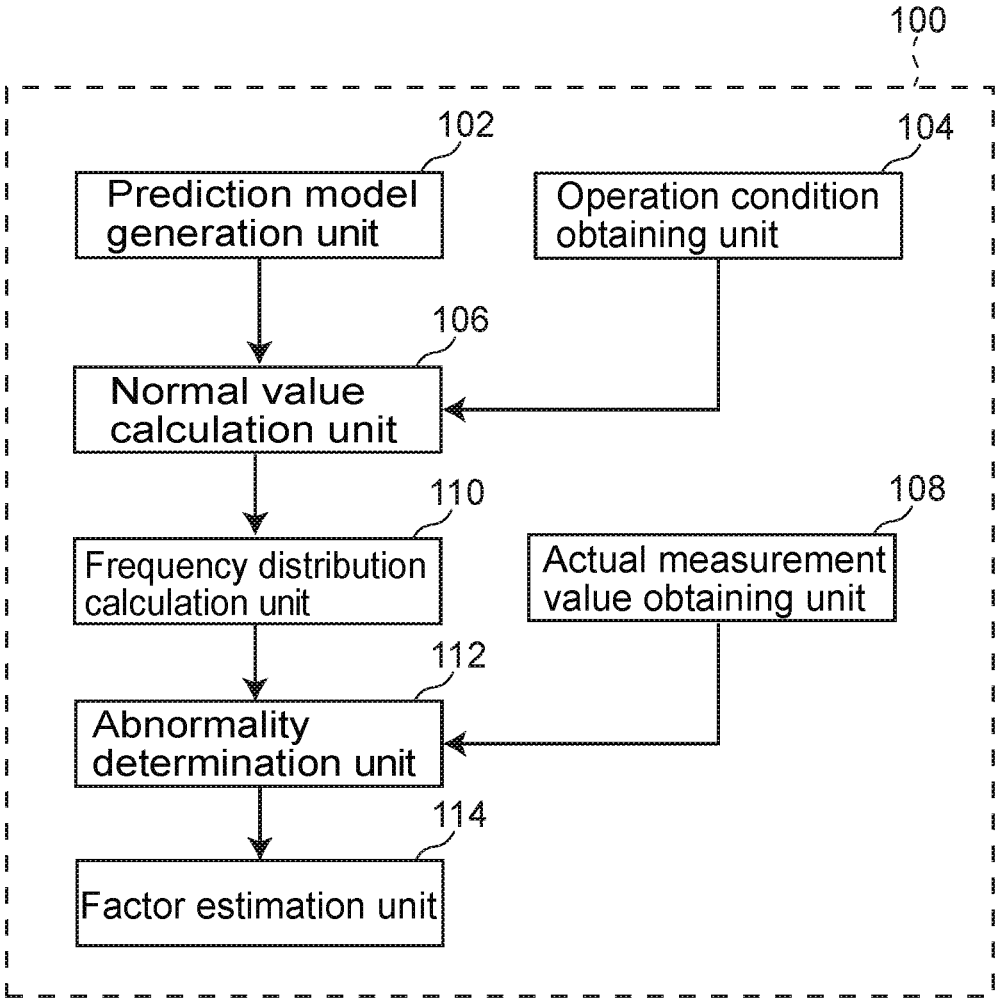
FIG. 3 is a block diagram of the configuration of an abnormality diagnosis system according to the first embodiment.
Figure 4:
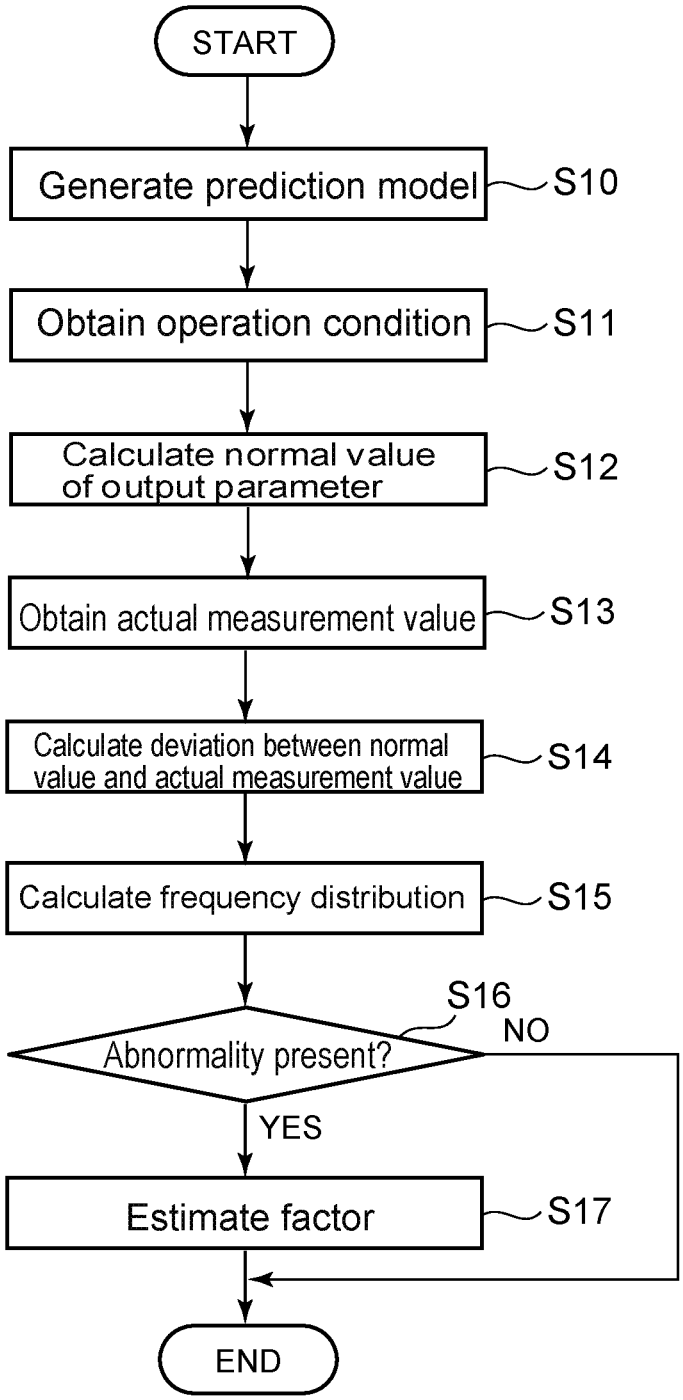
FIG. 4 is a flowchart showing steps of an abnormality diagnosis method performed by the abnormality diagnosis system in FIG. 3.

FIG. 3 is a block diagram of the configuration of an abnormality diagnosis system 100 according to the first embodiment. FIG. 4 is a flowchart showing steps of the abnormality diagnosis method performed by the abnormality diagnosis system 100 in FIG. 3.

As shown in FIG. 3, the abnormality diagnosis system 100 includes a prediction model generation unit 102, an operation condition obtaining unit 104, a normal value calculation unit 106, an actual measurement value obtaining unit 108, a frequency distribution calculation unit 110, an abnormality determination unit 112, and a factor estimation unit 114.

The abnormality diagnosis system 100 is configured by installing a program for performing the abnormality diagnosis method according to at least one embodiment of the present invention on a computation processing device such as a computer. In this case, the program may be stored in a computer-readable storage medium in advance or may be installed by reading the storage medium with the computation processing device.

In addition, FIG. 3 shows constituent elements of the abnormality diagnosis system 100 as functional blocks divided based on their functions. However, these functional blocks may be integrated or may be subdivided. Moreover, the abnormality diagnosis system 100 may include a single computation processing device or may include a plurality of computation processing devices (also including cloud servers or the like) which can communicate with each other.

The prediction model generation unit 102 generates a prediction model 111 capable of predicting a normal value of an output parameter for each operation condition of the hydrostatic transmission 1. The prediction model 111 is a computation model in which at least one input parameter included in the operation conditions of the hydrostatic transmission 1 is input as an input variable to perform a predetermined computation, thereby outputting a normal value of at least one output parameter included in the operation conditions as a corresponding output variable.

The prediction model generation unit 102 generates the prediction model by, for example, performing a learning process on the hydrostatic transmission 1 confirmed in advance to be in a normal state. The hydrostatic transmission 1 confirmed in advance to be in the normal state is, for example, a hydrostatic transmission immediately after passing a quality inspection in a product manufacturing process (for example, before product shipment). In this case, the prediction model generation unit 102 generates the prediction model in a manufacturer of the hydrostatic transmission 1 before shipment, and the generated prediction model may be stored in a predetermined storage device to be read out later as needed.

Figure 5:
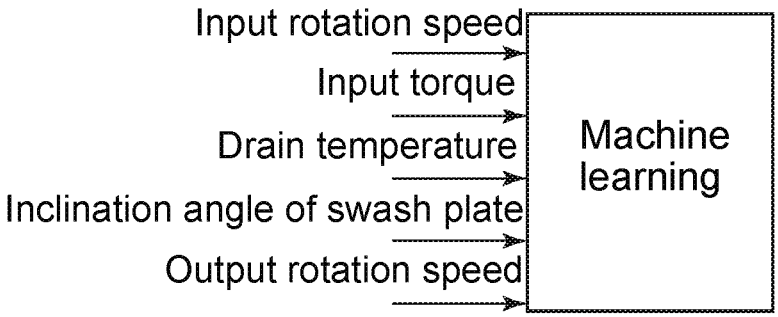
FIG. 5 is a schematic view conceptually showing learning control performed by a prediction model generation unit in FIG. 3.

The prediction model generation unit 102 performs the learning process by, for example, performing a test operation on the hydrostatic transmition transmission 1 confirmed to be in the normal state under predetermined operation conditions and obtaining its behavior (input/output characteristics). FIG. 5 is a schematic view conceptually showing learning control performed by the prediction model generation unit 102 in FIG. 3. Referring to FIG. 5, the hydrostatic transmission 1 confirmed to be in the normal state receives, as the predetermined operation conditions, an input rotation speed in the input shaft 2a, input torque, a drain temperature of the working oil discharged from the hydraulic pump 2 (the working oil in the high-pressure line 6A), the inclination angle of the swash plate 16 of the hydraulic pump 2, and an output rotation speed in the output shaft 4a of the hydraulic motor 4. The behavior (input/output characteristics) is thus obtained while changing the operation conditions which are given to the hydrostatic transmission 1 confirmed to be in the normal state, thereby specifying the input/output characteristics corresponding to the respective operation conditions and obtaining the prediction model. Such learning control is performed by, for example, machine learning which regresses a plurality of operation conditions based on random forests, making it possible to influence a predicted normal value of the output parameter by another factor and to generate the prediction model 111 capable of accurately predicting the normal value of the output parameter.

The prediction model 111 generated by the prediction model generation unit 102 is, for example, stored in a storage device of the abnormality diagnosis system 100 to be read out as needed. Consequently, the abnormality diagnosis system 100 can read out the prediction model 111 at an arbitrary timing and predict the normal value of the output parameter corresponding to each of the operation conditions. The prediction model 111 is generated by using an individual itself to be diagnosed as described above, and thus considers a variation and idiosyncrasies owing to an individual difference, making it possible to accurately predict the normal value of the output parameter on each of the operation conditions.

The operation condition obtaining unit 104 obtains operation conditions of the hydrostatic transmission 1 to be diagnosed. The operation conditions obtained here include parameters input as input parameters to the prediction model 111. In the present embodiment, the input rotation speed, the input torque, the drain temperature of the working oil discharged from the hydraulic pump 2 (the working oil in the high-pressure line 6A), the inclination angle of the swash plate 16 of the hydraulic pump 2 are obtained as the operation conditions.

The input rotation speed, the input torque, the drain temperature of the working oil discharged from the hydraulic pump 2 (the working oil in the high-pressure line 6A), the inclination angle of the swash plate 16 of the hydraulic pump 2 which are included in the operation conditions obtained by the operation condition obtaining unit 104 are obtained by receiving detection values of respective corresponding sensors (not shown) or a control signal by a controller (not shown) of the hydrostatic transmission 1.

Figure 6:
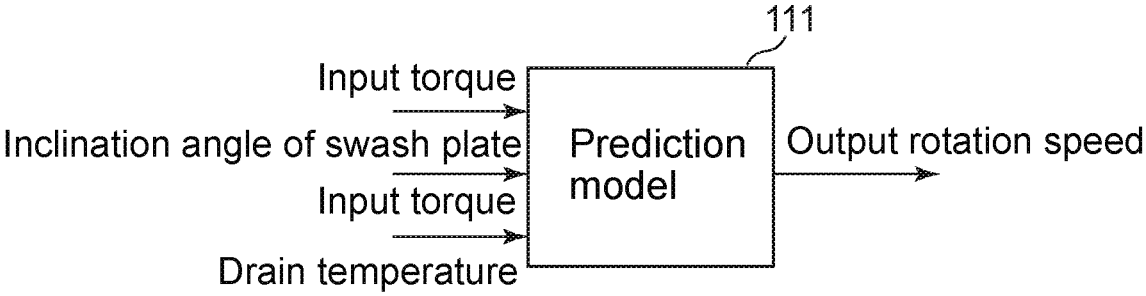
FIG. 6 is a schematic view conceptually showing a method of calculating a normal value of an output parameter using a prediction model.

The normal value calculation unit 106 calculates a normal value of an output parameter based on the prediction model 111. FIG. 6 is a schematic view conceptually showing a method of calculating the normal value of the output parameter using the prediction model 111. Referring to FIG. 6, the respective parameters (the input rotation speed, the input torque, the drain temperature of the working oil discharged from the hydraulic pump 2 (the working oil in the high-pressure line 6A), and the inclination angle of the swash plate 16 of the hydraulic pump 2) obtained by the operation condition obtaining unit 104 are input as the input parameters of the prediction model 111, obtaining the normal value of the corresponding output parameter (output rotation speed).

The actual measurement value obtaining unit 108 obtains an actual measurement value of the output parameter calculated by the prediction model 111. In the present embodiment, since the normal value of the output rotation speed is predicted as the output parameter of the prediction model 111, the actual measurement value obtaining unit 108 obtains the actual measurement value of the output rotation speed from a sensor (not shown) provided in the output shaft 4*a* of the hydraulic motor 4.

The frequency distribution calculation unit 110 calculates a frequency distribution with regard to a deviation between the normal value calculated by the normal value calculation unit 106 and the actual measurement value obtained by the actual measurement value obtaining unit 108. The normal value calculation unit 106 continuously calculates the normal value of the output parameter using the prediction model 111 with time, and the actual measurement value obtaining unit 108 continuously obtains the actual measurement value of the output parameter with time. The frequency distribution calculation unit 110 obtains the deviation between the normal value and the actual measurement value of the output parameter which are temporally and continuously obtained as described above, and calculates the frequency distribution based on the deviation. The deviation between the normal value and the actual measurement value varies to no small extent with time, resulting in the frequency distribution having a predetermined waveform.

The abnormality determination unit112 calculates an average of the deviation by analyzing the frequency distribution calculated by the frequency distribution calculation unit 110 and determines the presence or absence of an abnormality in the hydrostatic transmission 1 by comparing the average with a threshold. The frequency distribution calculated by the frequency distribution calculation unit 110 indicates a normal distribution if the hydrostatic transmission 1 has no abnormality, but indicates a waveform deviated from the normal distribution if the hydrostatic transmission 1 has some abnormality. Thus, if the hydrostatic transmission 1 has the abnormality, the average calculated based on the frequency distribution is diverted from the threshold.

The factor estimation unit 114 estimates the factor of the abnormality based on the waveform of the frequency distribution, if the abnormality determination unit 112 determines the presence of the abnormality. As described above, the abnormality occurred in the diagnosis target influences the waveform of the frequency distribution. However, the influence given by the abnormality varies with the type thereof. Therefore, the factor estimation unit 114 estimates the factor influencing the frequency distribution by analyzing the waveform of the frequency distribution.

Next, the abnormality diagnosis method using the abnormality diagnosis system 100 with the above configuration will be described in detail with reference to FIG. 4.

First, the prediction model generation unit 102 generates the prediction model 111 in advance by performing the learning process on the hydrostatic transmission 1 confirmed to be in the normal state (step S10). Such generation of the prediction model 111 is performed before steps to be described later and is performed on the hydrostatic transmission immediately after passing the quality inspection in the product manufacturing process (for example, before product shipment). Thus, it is possible to prepare the accurate prediction model 111 considering the variation and the idiosyncrasies owing to the individual difference of the hydrostatic transmission 1 to be diagnosed.

Subsequently, the operation condition obtaining unit 104 obtains the operation conditions of the hydrostatic transmission 1 (step S11). The operation conditions are obtained by, for example, receiving control signals for various sensors provided for the hydrostatic transmission 1 or the hydrostatic transmission 1. The input rotation speed, the input torque, the drain temperature of the working oil discharged from the hydraulic pump 2 (the working oil in the high-pressure line 6A), and the inclination angle of the swash plate 16 of the hydraulic pump 2 to be the input parameters of the prediction model 111 in subsequent step S12 are obtained.

Subsequently, the normal value calculation unit 106 calculates, based on the prediction model 111 generated in advance in step S10, the normal value of the output parameter corresponding to the operation conditions obtained in step S11 (step S12). That is, the normal value calculation unit 106 receives the operation conditions obtained by the operation condition obtaining unit 104 (the input rotation speed, the input torque, the drain temperature of the working oil discharged from the hydraulic pump 2 (the working oil in the high-pressure line 6A), and the inclination angle of the swash plate 16 of the hydraulic pump 2) and inputs the operation conditions to the prediction model 111, calculating the normal value of the corresponding output parameter (output rotation speed) (see FIG. 5).

Figures 7A, 7B, 7C:
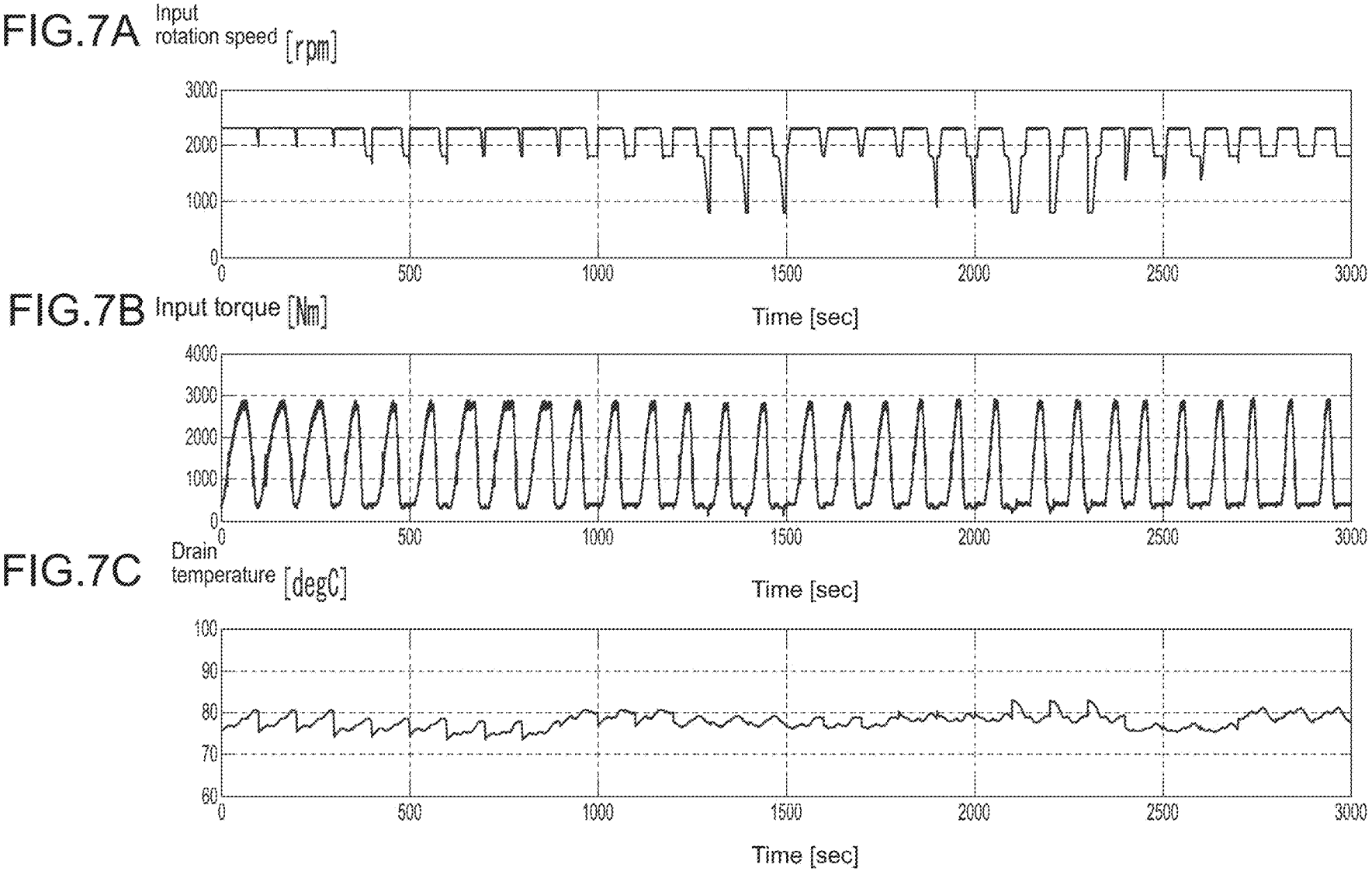
FIG. 7A is a graph of an example of the transition of the normal value of the output parameter predicted by operation conditions and the prediction model.
FIG. 7B is a graph of an example of the transition of the normal value of the output parameter predicted by the operation conditions and the prediction model.
FIG. 7C is a graph of an example of the transition of the normal value of the output parameter predicted by the operation conditions and the prediction model.
Figure 7D:
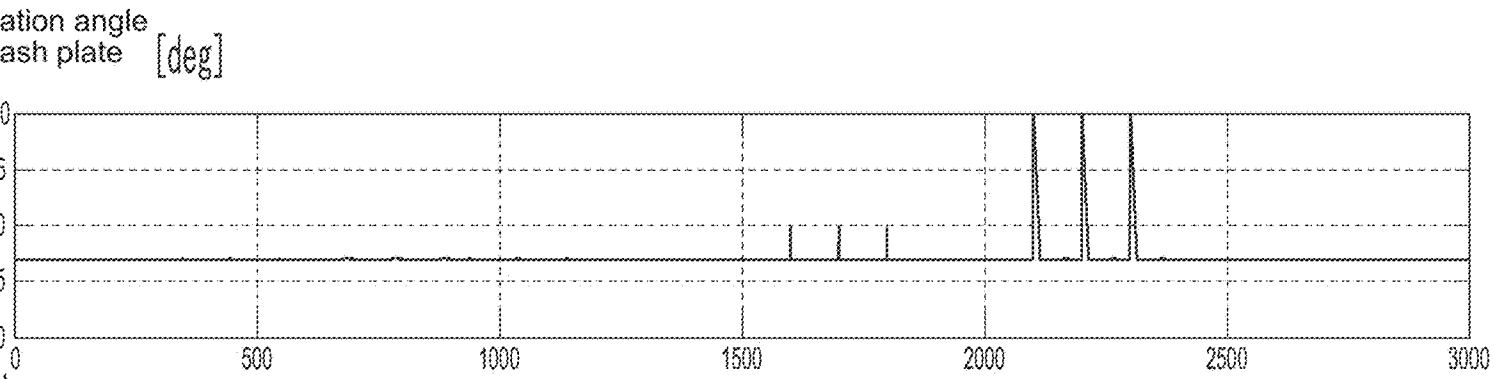
FIG. 7D is a graph of an example of the transition of the normal value of the output parameter predicted by the operation conditions and the prediction model.
Figure 7E:
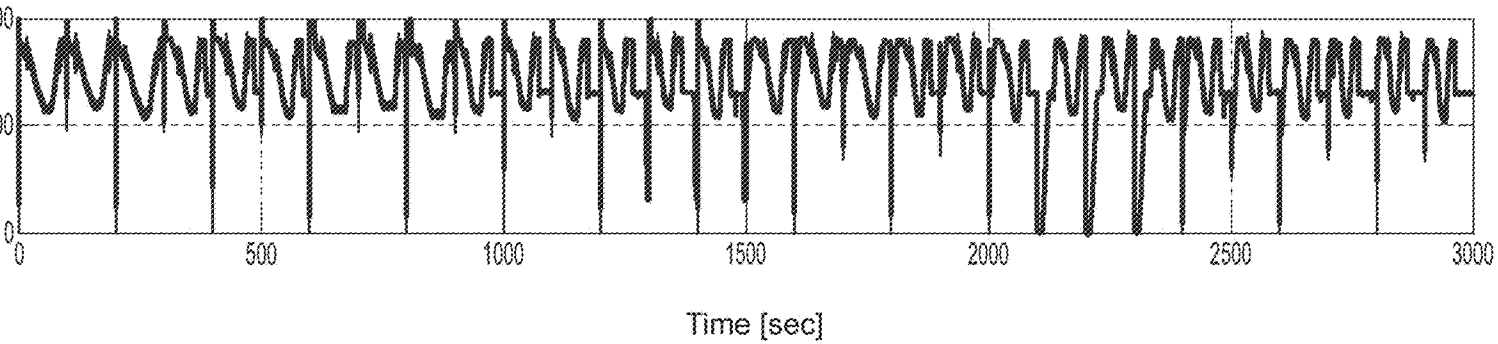
FIG. 7E is a graph of an example of the transition of the normal value of the output parameter predicted by the operation conditions and the prediction model.

FIGS. 7A to 7E are graphs each showing an example of the transition of the normal value of the output parameter predicted by the operation conditions and the prediction model. FIGS. 7A to 7D show temporal changes of the input rotation speed, the input torque, the drain temperature of the working oil discharged from the hydraulic pump 2 (the working oil in the high-pressure line 6A), and the inclination angle of the swash plate 16 of the hydraulic pump 2, all of which are the operation conditions. FIG. 7E shows a temporal change of the output parameter (output rotation speed) calculated based on the prediction model 111 from the operation conditions of FIGS. 7A to 7D.

Subsequently, the actual measurement value obtaining unit 108 obtains the actual measurement value of the output parameter calculated in step S12 (step S13). In the present embodiment, since the normal value of the output rotation speed is predicted as the output parameter in step S12 as described above, the actual measurement value obtaining unit 108 obtains the actual measurement value of the output rotation speed. Such an actual measurement value of the output rotation speed is obtained by obtaining a detection value of a rotation-speed sensor (not shown) provided in the output shaft 4*a* of the hydraulic motor 4.

Subsequently, the frequency distribution calculation unit 110 obtains the deviation between the normal value of the output parameter calculated in step S12 and the actual measurement value of the output parameter obtained in step S13 (step S14), and calculates the frequency distribution with respect to the deviation (step S15).

Figure 8:
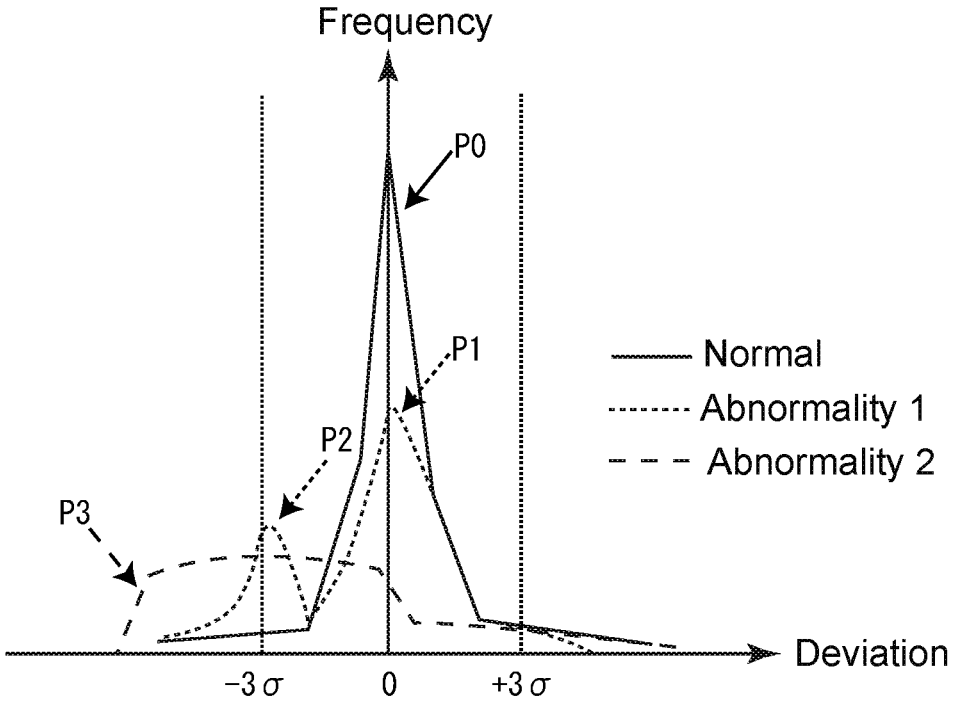
FIG. 8 is a graph of an example of a frequency distribution calculated in step S15 of FIG. 4.

FIG. 8 is a graph of an example of the frequency distribution calculated in step S15 of FIG. 4. Date represented by a solid line in FIG. 8 indicates a frequency distribution in a case in which the hydrostatic transmission 1 has no abnormality, and has a normal distribution centered on zero. On the other hand, two sets of date represented by dashed lines in FIG. 8 respectively indicate frequency distributions in a case in which the hydrostatic transmission 1 has abnormality 1 and abnormality 2.

Abnormality 1 and abnormality 2 distinctively indicate abnormalities having different factors (corresponding to factor 1 and factor 2 to be described later). Since the abnormality determination unit 112 merely determines the presence or absence of the abnormality, abnormality 1 and abnormality 2 need not be discriminated.

Subsequently, the abnormality determination unit 112 determines the presence or absence of the abnormality in the hydrostatic transmission 1 based on the frequency distribution (step S16). As shown in FIG. 8, the abnormality occurred in the hydrostatic transmission 1 influences the frequency distribution. Therefore, the abnormality determination unit 112 determines the presence or absence of the abnormality by evaluating the frequency distribution calculated in step S15. More specifically, the abnormality determination unit 112 calculates the average of the deviation based on the frequency distribution and determines the presence or absence of the abnormality based on whether the average exceeds a threshold serving as a preset reference value.

The frequency distribution is normal if the hydrostatic transmission 1 has no abnormality (see normal data of FIG. 8), and thus the average of the deviation becomes minimum and does not exceed the threshold. On the other hand, the frequency distribution is deviated from the normal distribution if the hydrostatic transmission 1 has the abnormality (see the data of abnormality 1 and abnormality 2 in FIGS. 7A to 7E), and thus the average of the deviation increases and exceeds the threshold. The abnormality determination unit 112 determines the presence or absence of the abnormality in the hydrostatic transmission 1 based on the magnitude of the average of the deviation thus obtained from the frequency distribution.

In the present embodiment, the average is used as an evaluation parameter of the frequency distribution in the abnormality determination unit 112. However, it is possible to widely adopt, as the evaluation parameter, a parameter average −3σ (σ: standard deviation), a median value, or a mode value which can evaluate an influence on the frequency distribution by the abnormality.

If the abnormality determination unit 112 determines the presence of the abnormality (step S16: YES), the factor estimation unit 114 estimates the factor of the abnormality (step S17). As shown in FIG. 8, the presence or absence of the abnormality influences the waveform of the frequency distribution. However, the given influence varies with the factor of the abnormality. Therefore, the abnormality determination unit 112 determines the factor of the abnormality by evaluating the waveform of the frequency distribution.

A factor estimation method by the factor estimation unit 114 will be described in detail here. In the present embodiment, the following two factors are given as factors to be estimated by the factor estimation unit 114.

(factor 1) A friction coefficient on the sliding surface 12*a* increases, decreasing an output.

(factor 2) An abrasion amount obtained between the cylinders 24 and the pistons 26 increases, widening the gaps between the cylinders 24 and the pistons 26, and decreasing the output due to an increasing leakage amount of working fluid.

According to the research conducted by the present inventors, it is found that there is a peak position in the frequency distribution as an effective index for distinctively estimating these factors. In particular, it is possible to distinctively estimate factor 1 and factor 2 described above based on whether the peak position is within a range of ±3σ with reference to the standard deviation σ of the frequency distribution. For example, the data of abnormality 1 in FIG. 8 indicates a frequency distribution corresponding to factor 1, and both peaks P1 and P2 of the frequency distribution are included in the range of ±3σ. On the other hand, the data of abnormality 2 in FIG. 8 indicates a frequency distribution corresponding to factor 2 and has a broad peak so as to reach outside the range of ±3σ. As described above, the frequency distributions corresponding to factor 1 and factor 2 respectively have characteristic waveforms, allowing the factor estimation unit 114 to distinctively estimate factor 1 and factor 2 by analyzing the waveforms of the frequency distributions.

A difference between the waveforms of the frequency distributions in factor 1 and factor 2 may arise in all load regions of the hydrostatic transmission 1. It is found, however, that the difference remarkably appears in a high-load region with a load greater than or equal to a predetermined value. Thus, the factor estimation unit 114 can estimate the factor more accurately by estimating the factor based on the above-described method in a frequency distribution obtained when the hydrostatic transmission 1 operates in the high-load region.

Figure 9:
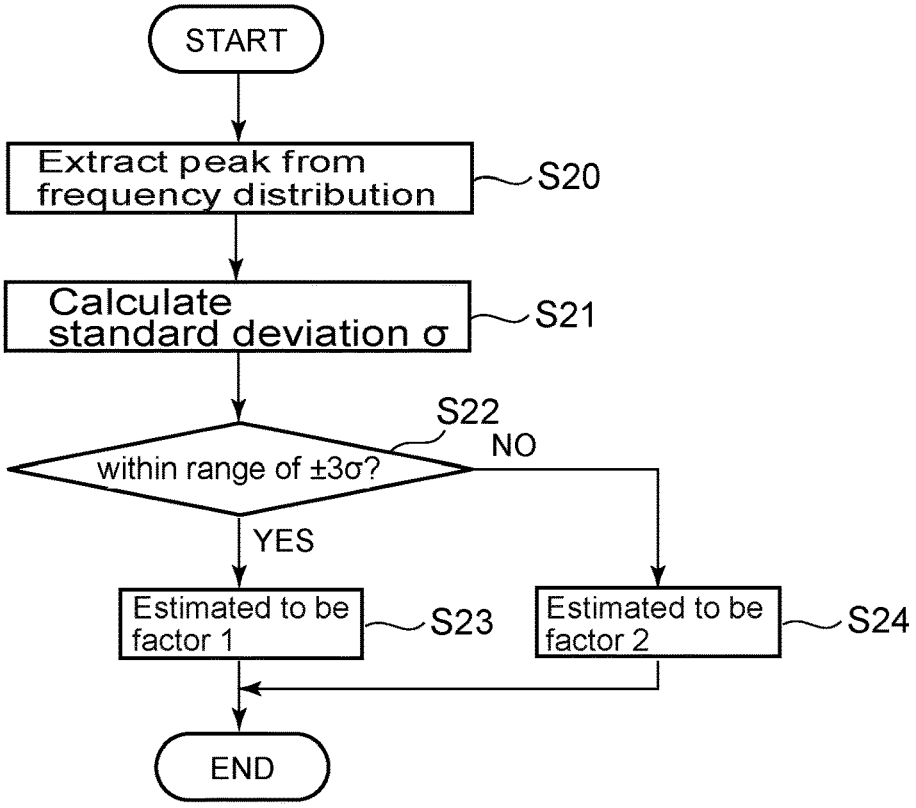
FIG. 9 is a sub-flowchart of step S17 in FIG. 4.

The factor estimation method by the factor estimation unit 114 will be described in detail here with reference to FIG. 9. FIG. 9 is a sub-flowchart of step S17 in FIG. 4.

First, the factor estimation unit 114 extracts a peak from a frequency distribution with regard to the hydrostatic transmission 1 determined as having the abnormality (step S20). If the frequency distribution is the data of abnormality 1 in FIG. 8, the peak P1 obtained at zero and the peak P2 diverted from the peak P1 are extracted. On the other hand, if the frequency distribution is the data of abnormality 2 in FIG. 8, a peak P3 diverted from zero is extracted.

Subsequently, the factor estimation unit 114 calculates the standard deviation σ from the frequency distribution (step S21), and determines whether the peak extracted in step S20 using the standard deviation σ is within the range of ±3σ (step S22). If the peak included in the frequency distribution is within the range of ±3σ as the date of abnormality 1 in FIG. 8 (step S22: YES), the factor estimation unit 114 estimates that the factor of the abnormality is "factor 1" (step S23). On the other hand, if the peak included in the frequency distribution is out of the range of ±3σ as the date of abnormality 2 in FIG. 8 (step S22: NO), the factor estimation unit 114 estimates that the factor of the abnormality is "factor 2" (step S24).

As described above, factor 1 and factor 2 can be discriminated more clearly if the load of the hydrostatic transmission 1 is in the high-load region with the load greater than or equal to the predetermined value. Therefore, steps S22 to S24 may be performed on the condition that the hydrostatic transmission 1 has the load greater than or equal to the predetermined value.

Figure 10:
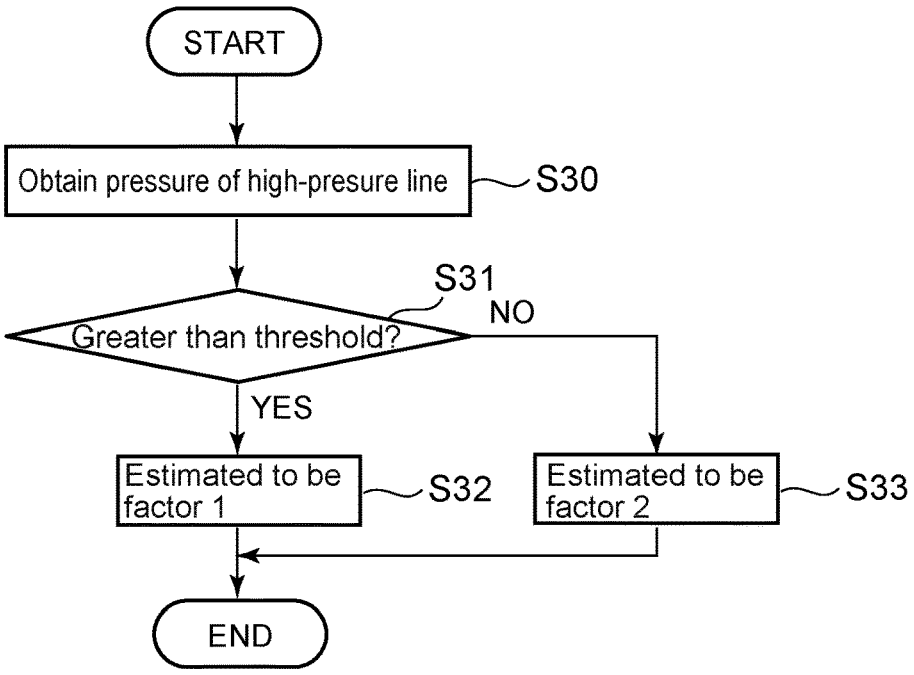
FIG. 10 is a sub-flowchart of a modified example of FIG. 9.

The above-described factor estimation may be performed by a method to be described below. FIG. 10 is a sub-flowchart of a modified example of FIG. 9. The present modified example is effective in a case in which a pressure in the high-pressure line 6A is configured to be detected.

If the abnormality determination unit 112 determines the presence of the abnormality (step S16: YES), the factor estimation unit 114 obtains the pressure in the high-pressure line 6A (step S30) and determines whether the pressure is greater than a threshold serving as a reference value (step S31). The threshold compared with the pressure may be a pressure value in a normal time and a specification value preset as product specification, or may be a predicted value calculated based on the prediction model 111 as the above-described output rotation speed.

If the pressure is greater than the threshold (step S31: YES), the factor estimation unit 114 estimates the factor of the abnormality is "factor 1" (step S32). This is because a hydraulic pressure in the high-pressure line 6A rises due to an increase in torque needed to retain the same rotation speed caused by increasing friction coefficients between the sliding surface 12*a* and the valve plate 14, between the piston 26 and the first cylinder 24A, and between the piston 26 and the second cylinder 24B on an output-motor side.

On the other hand, if the pressure is less than or equal to the threshold (step S31: NO), the factor estimation unit 114 estimates the factor of the abnormality is "factor 2" (step S33). This is because, unlike the case of factor 1, the hydraulic pressure does not rise if leakage of working fluid from compression chambers defined by the cylinders 24 and the pistons 26 increases by progressing abrasion between the cylinders 24 and the pistons 26.

As described above, according to the first embodiment, it is possible to determine the abnormality in the hydraulic device and estimate the factor of the abnormality by comparing the average of the deviation between the normal value and the actual measurement value calculated by the prediction model with the threshold.

Second Embodiment

Figure 11:
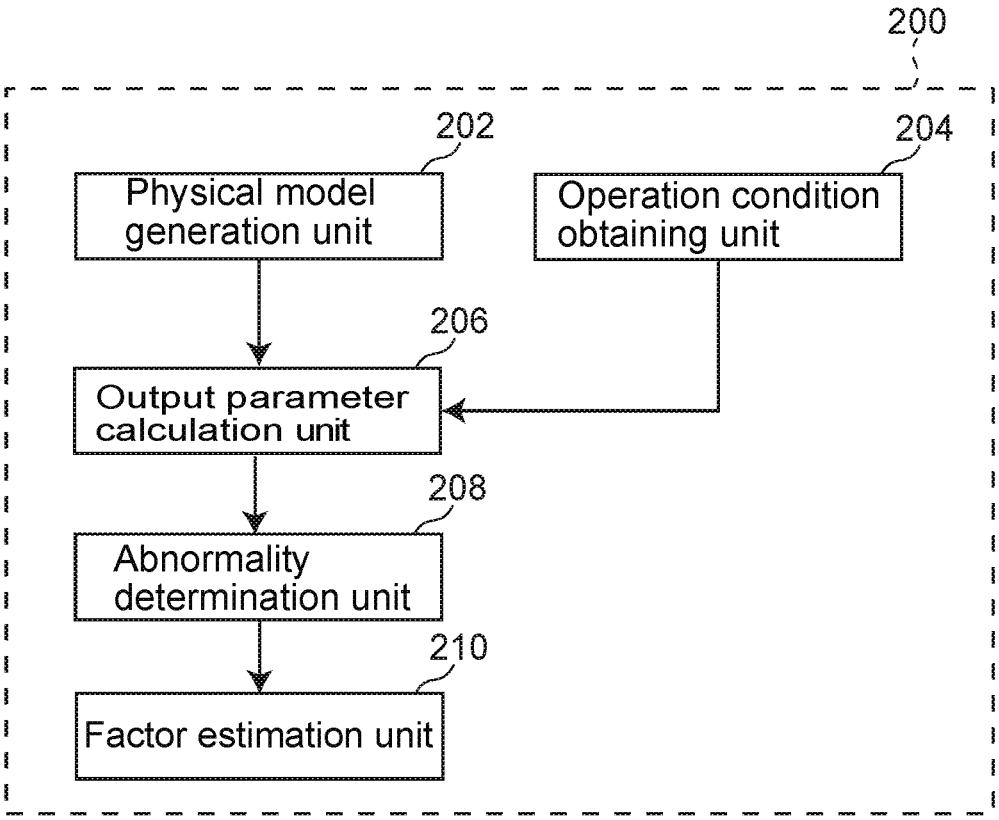
FIG. 11 is a block diagram of the configuration of an abnormality diagnosis system.
Figure 12:
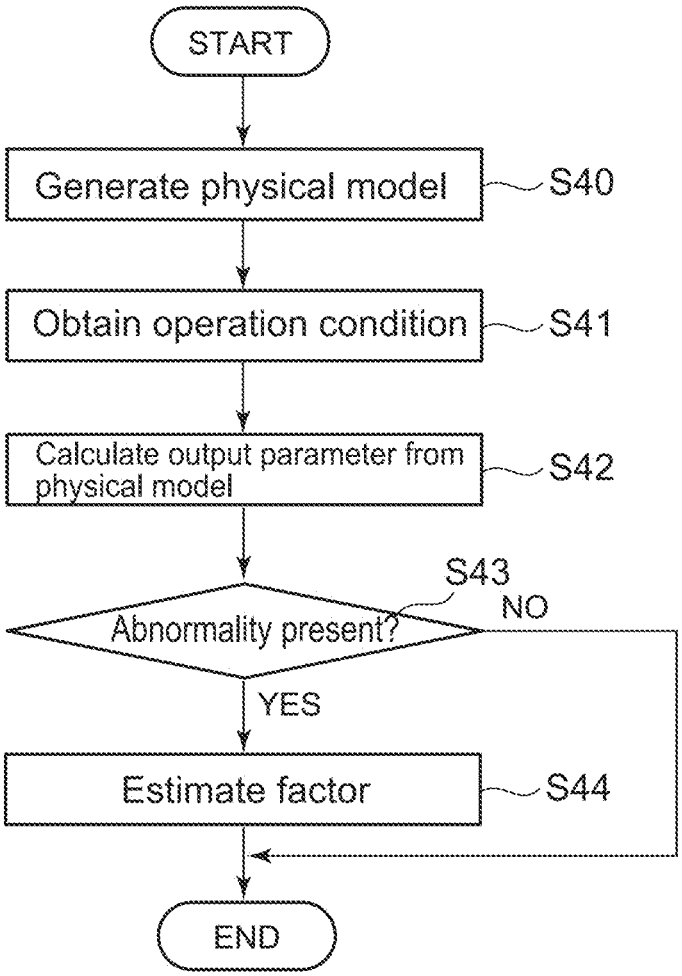
FIG. 12 is a flowchart showing steps of an abnormality diagnosis method performed by the abnormality diagnosis system in FIG. 11.

Next, an abnormality diagnosis system 200 and an abnormality diagnosis method performed by the abnormality diagnosis system 200 according to the second embodiment will be described. FIG. 11 is a block diagram of the configuration of the abnormality diagnosis system 200. FIG. 12 is a flowchart showing steps of the abnormality diagnosis method performed by the abnormality diagnosis system 200 in FIG. 11.

As shown in FIG. 11, the abnormality diagnosis system 200 includes a physical model generation unit 202, an operation condition obtaining unit 204, an output parameter calculation unit 206, an abnormality determination unit 208, and a factor estimation unit 210.

The abnormality diagnosis system 200 is configured by installing a program for performing the abnormality diagnosis method according to at least one embodiment of the present invention on a computation processing device such as a computer. In this case, the program may be stored in a computer-readable storage medium in advance or may be installed by reading the storage medium with the computation processing device.

Figure 13:
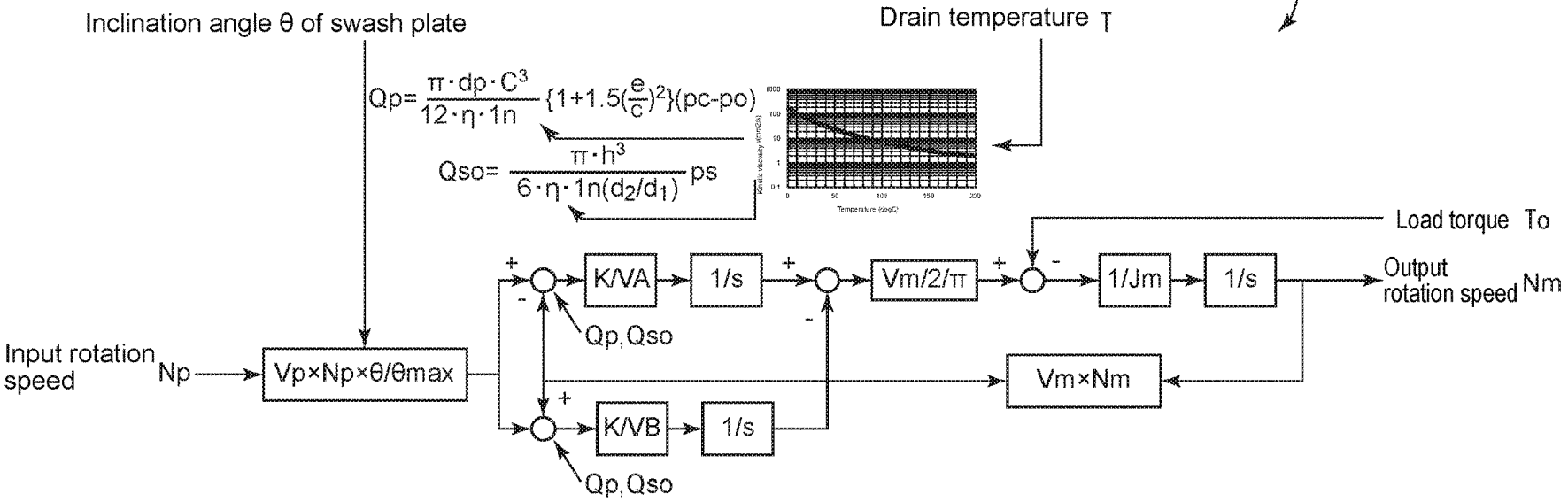
FIG. 13 is a diagram of an example of a physical model generated by a physical model generation unit.

First, the physical model generation unit 202 generates a physical model 220 corresponding to a physical structure of a hydrostatic transmission 1 to be diagnosed (step S40). FIG. 13 is a diagram of an example of a physical model generated by the physical model generation unit 202.

The physical model 220 shown in FIG. 13 is a computation model in which at least one input parameter included in the operation conditions of the hydrostatic transmission 1 is input as an input variable to perform a predetermined computation, thereby outputting a normal value of at least one output parameter included in the operation conditions as a corresponding output variable.

Referring to FIG. 13, an input rotation speed Np in an input shaft 2*a*, an inclination angle θ of a swash plate 16, a drain temperature T of working oil discharged from a hydraulic pump 2 (working oil in a high-pressure line 6A), and an output torque To in an output shaft 4*a* of a hydraulic motor 4 are input to the physical model 220 as operation conditions, and an output rotation speed Nm in the output shaft 4*a* of the hydraulic motor 4 is output as an output parameter.

The physical model 220 includes a displacement Vp of the hydraulic pump 2, a maximum inclination angle θmax of the swash plate 16, a bulk modulus K of the working oil, a volume VA of the high-pressure line 6A, a Laplace operator s, a displacement Vm of the hydraulic motor 4, an inertia moment Jm of the hydraulic motor 4, a leakage amount $Q_p$ from pistons 26, and a leakage amount $Q_{so}$ from a pad. In the physical model 220, the flow rate of oil flowing into a suction port and a discharge port of the hydraulic pump 2, a leakage amount from gaps formed between the pistons 26 and cylinders 24 and a leakage amount from a hydrostatic pad of a piston shoe, and a discharge port (pump discharge port) and an input port (pump discharge port) of the hydraulic motor 4 by an output-side motor rotation are calculated from the inclination angle θ of the swash plate 16 and the input rotation speed Np. From the balance of the aforementioned three flow rates, the time rate of change of a pressure of each port is calculated. Then, the pressure of each port is obtained by integrating the time rate of change of the pressure. Torque of the hydraulic motor 4 is calculated from a pressure difference between the ports. Rotational torque of the hydraulic motor 4 is obtained from a difference from the calculated torque and a load torque $T_0$. Rotational acceleration is obtained from the rotational torque. Motor rotation speed is computed by time-integrating the rotational acceleration. A series of energy transfer processes are performed by computing the motor flow rate by multiplying the displacement of the hydraulic motor 4 with the motor rotation speed, outputting fluid energy discharged from the hydraulic pump 2 as mechanical energy with the hydraulic motor 4, and recovering fluid which has consumed energy to the pump.

The leakage amount $Q_p$ from the pistons 26 and the leakage amount $Q_{so}$ from the pad are respectively given by:

$$Q_p = \frac{\pi \cdot d_p \cdot C^3}{12 \cdot \eta \cdot l_m}\left(1 + 1.5\left(\frac{e}{C}\right)^3\right)(p_c - p_o) \tag{1}$$

$$Q_{so} = \frac{\pi \cdot h^3}{6 \cdot \eta \cdot l_n(d_2/d_1)} p_s \tag{2}$$

Figure 14A:
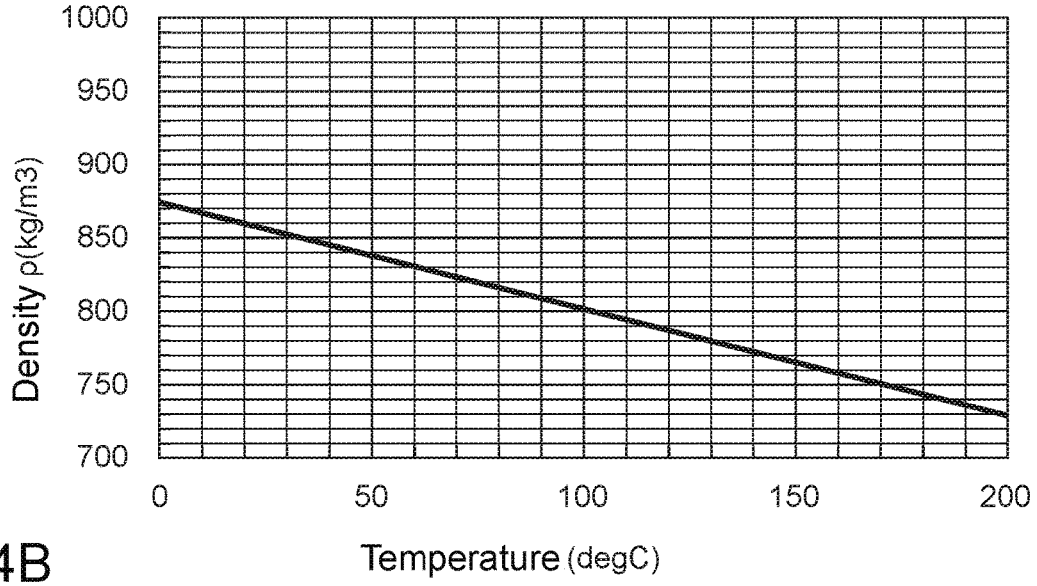
FIG. 14A is a graph of a characteristic function indicating temperature dependency of the density of working oil.
Figure 14B:
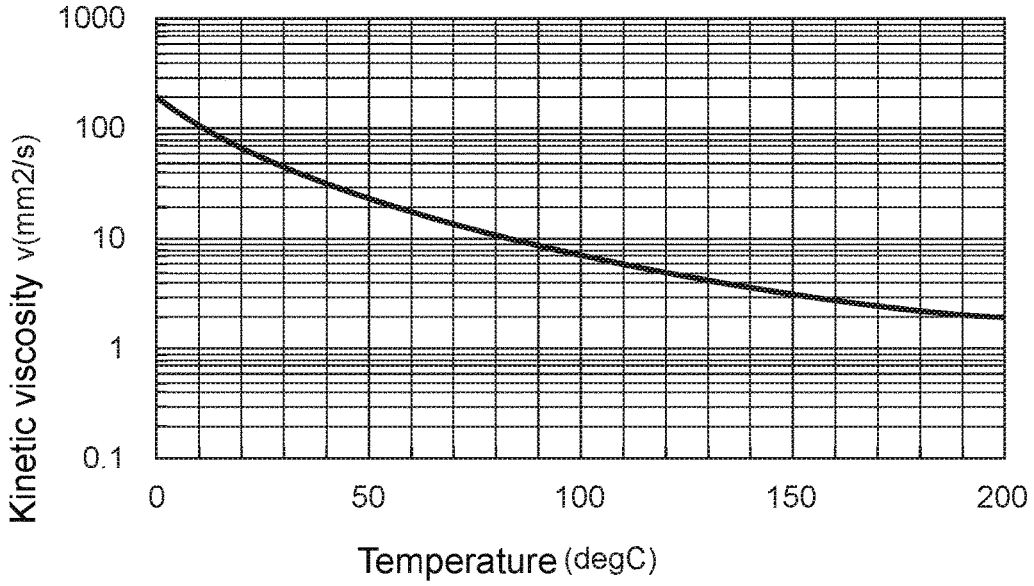
FIG. 14B is a graph of a characteristic function indicating temperature dependency of the kinetic viscosity of the working oil.

The denominators of equations (1) and (2) each include a viscosity η of the working oil. The viscosity η of the working oil is generally obtained by:

$$\eta = \rho \times \eta \tag{3}$$

using a density ρ and a kinetic viscosity ν. As shown in FIGS. 14A and 14B, the density ρ and the kinetic viscosity ν of the working oil each have temperature dependency, and the viscosity η has a non-linear correlation with respect to a temperature (FIGS. 14A and 14B are respectively graphs of characteristic functions indicating temperature dependencies of the density ρ and the kinetic viscosity ν of the working oil).

The above-described physical model 220 uses equations (1) and (2) including the viscosity η of the working oil, and thus substantially considers the temperature dependencies of the density ρ and the kinetic viscosity ν of the working oil. Therefore, it is possible to calculate an accurate output parameter considering the non-linear correlation of the viscosity η of the working oil.

Subsequently, the operation condition obtaining unit 204 obtains the operation conditions to be input parameters of the physical model 220 (step S41). In the above example, the drain temperature T of the working oil discharged from the hydraulic pump 2 (the working oil in the high-pressure line 6A) and the output torque To in the output shaft 4*a* of the hydraulic motor 4 are obtained based on the control signal or the detection values from the respective sensors provided for the hydrostatic transmission 1.

Subsequently, the output parameter calculation unit 206 calculates, using the physical model 220 generated by the physical model generation unit 202, an output parameter corresponding to the operation condition obtained by the operation condition obtaining unit 204 (step S42). In the above example, the output rotation speed Nm in the output shaft 4*a* of the hydraulic motor 4 is calculated as the output parameter. Since the physical model 220 used to compute the output parameter uses equations (1) and (2) including the viscosity η of the working oil, and thus substantially considers the temperature dependencies of the density ρ and the kinetic viscosity ν of the working oil, it is possible to calculate the accurate output parameter.

Subsequently, the abnormality determination unit 208 determines an abnormality in the hydrostatic transmission 1 by comparing the output parameter calculated by the output parameter calculation unit 206 with a reference value (step S43). Then, if the abnormality determination unit 208 determines the presence of the abnormality (step S43: YES), the factor estimation unit 210 estimates a factor by calculating an evaluation parameter corresponding to each factor based on the physical model 220 (step S44).

In step S44, the factor estimation unit 210 estimates the factor by, for example, directly computing the leakage amount $Q_p$ from the piston 26 and the leakage amount $Q_{so}$ from the pad by equations (1) and (2) of the physical model 220, comparing each leakage amount with a corresponding one of reference values, and thereby specifying an evaluation parameter with a deviation from the corresponding one of the reference values exceeding a threshold. In this case, it is also possible to quantitatively evaluate the abnormality factor in order to concretely obtain the leakage amount $Q_p$ from the pistons 26 and the leakage amount $Q_{so}$ from the pad.

As described above, according to the second embodiment, it is possible to accurately and computationally obtain the output parameter based on the physical structure of the hydrostatic device by using the physical model 220 capable of calculating the output parameter corresponding to the operation condition. Comparing the thus obtained output parameter with the reference value, it is possible to accurately determine the abnormality.

INDUSTRIAL APPLICABILITY

At least one embodiment of the present invention can be used for an abnormality diagnosis method for a hydraulic device which includes a hydraulic pump and a driven device driven by the hydraulic pump, and an abnormality diagnosis system for the hydraulic device.

The invention claimed is:

1. An abnormality diagnosis method for a hydraulic device which includes a hydraulic pump and a driven device driven by the hydraulic pump, the abnormality diagnosis method comprising:

generating, by a processor performing machine learning, a prediction model capable of predicting a normal value of an output parameter of the hydraulic device for each operation condition of the hydraulic device;

obtaining, by the processor, an operation condition of the hydraulic pump by receiving a detection value of a sensor or a control signal by a controller;

calculating, by the processor, the normal value of the output parameter corresponding to the operation condition of the hydraulic pump using the prediction model;

obtaining, by the processor via the sensor, an actual measurement value of the output parameter with respect to the hydraulic pump;

calculating, by the processor, a frequency distribution with regard to a deviation between the normal value and the actual measurement value;

calculating, by the processor, an average of the deviation based on the frequency distribution, and determining, by the processor, that the hydraulic device has an abnormality if the average exceeds a threshold; and estimating, by the processor, a factor of the abnormality based on a range of the deviation where a waveform peak of the frequency distribution exists, if the processor has determined that the hydraulic device has the abnormality.

2. The abnormality diagnosis method according to claim 1, wherein the estimating the factor includes:

calculating, by the processor, a standard deviation σ with respect to the frequency distribution calculated in a case in which the hydraulic device has a load greater than or equal to a predetermined value; and estimating, by the processor, that the factor is an increasing friction coefficient in a sliding portion inside the hydraulic pump, if a peak is within a range of ±3σ in the frequency distribution.

3. The abnormality diagnosis method according to claim 1, wherein the estimating the factor includes:

calculating, by the processor, a standard deviation σ with respect to the frequency distribution which has been calculated; and estimating, by the processor, that the factor is an increasing abrasion amount inside the hydraulic pump, if a peak is out of a range of ±3σ in the frequency distribution.

4. The abnormality diagnosis method according to claim 1, wherein the operation condition of the hydraulic pump includes a temperature of working oil discharged from the hydraulic pump.

5. The abnormality diagnosis method according to claim 1, wherein the driven device is a hydraulic motor, and wherein the output parameter is an output rotation speed of the hydraulic motor.

6. An abnormality diagnosis method for a hydraulic device which includes a hydraulic pump and a driven device driven by the hydraulic pump, the abnormality diagnosis method comprising:

generating, by a processor performing machine learning, a prediction model capable of predicting a normal value of an output parameter of the hydraulic device for each operation condition of the hydraulic device;

obtaining, by the processor, an operation condition of the hydraulic pump by receiving a detection value of a sensor or a control signal by a controller;

calculating, by the processor, the normal value of the output parameter corresponding to the operation condition of the hydraulic pump using the prediction model;

obtaining, by the processor via the sensor, an actual measurement value of the output parameter with respect to the hydraulic pump;

calculating, by the processor, a frequency distribution with regard to a deviation between the normal value and the actual measurement value;

calculating, by the processor, an average of the deviation based on the frequency distribution and determining, by the processor, that the hydraulic device has an abnormality, if the average exceeds a threshold; and estimating, by the processor, a factor of the abnormality based on a pressure of working oil discharged from the hydraulic pump, if the processor has determined that the hydraulic device has the abnormality.

7. The abnormality diagnosis method for the hydraulic device according to claim 6, wherein the estimating the factor includes:

estimating, by the processor, that the factor is an increasing friction coefficient in a sliding portion inside the hydraulic pump, if the pressure of the working oil discharged from the hydraulic pump increases as compared with a normal time.

8. The abnormality diagnosis method according to claim 6, wherein the estimating the factor includes:

estimating, by the processor, that the factor is an increasing abrasion amount inside the hydraulic pump, if the pressure does not increase as compared with a normal time.

9. The abnormality diagnosis method according to claim 6, wherein the operation condition of the hydraulic pump includes a temperature of the working oil discharged from the hydraulic pump.

10. The abnormality diagnosis method according to claim 6, wherein the driven device is a hydraulic motor, and wherein the output parameter is an output rotation speed of the hydraulic motor.

11. An abnormality diagnosis system for a hydraulic device which includes a hydraulic pump and a driven device configured to be driven by the hydraulic pump, the abnormality diagnosis system comprising:

a processor; and a non-transitory computer-readable medium having stored thereon executable instructions that, when executed by the processor, cause the abnormality diagnosis system to function as:

a prediction model generation unit which generates, by machine learning, a prediction model capable of predicting a normal value of an output parameter of the hydraulic device for each operation condition of the hydraulic device;

an operation condition obtaining unit which obtains an operation condition of the hydraulic pump by receiving a detection value of a sensor or a control signal by a controller;

a normal value calculation unit which calculates, using the prediction model, the normal value of the output parameter corresponding to the operation condition of the hydraulic pump obtained by the operation condition obtaining unit;

an actual measurement value obtaining unit which obtains, via the sensor, an actual measurement value of the output parameter with respect to the hydraulic pump;

a frequency distribution calculation unit which calculates a frequency distribution with regard to a deviation between the normal value calculated by the normal value calculation unit and the actual measurement value obtained by the actual measurement value obtaining unit;

an abnormality determination unit which calculates an average of the deviation based on the frequency distribution and determines that the hydraulic device has an abnormality if the average exceeds a threshold; and a factor estimation unit which estimates a factor of the abnormality based on a range of the deviation where a waveform peak of the frequency distribution exists, if the abnormality determination unit determines that the hydraulic device has the abnormality.

* * * * *